United States Patent [19]

Jacobsson

[11] 4,137,731

[45] Feb. 6, 1979

[54] THREAD SUPPLY DEVICE FOR TEXTILE MACHINE HAVING COMMON THREAD CONTROL AND TENSION SENSING ELEMENT

[75] Inventor: Kurt A. G. Jacobsson, Ulricehamn, Sweden

[73] Assignee: Aktiebolaget IRO, Ulricehamn, Sweden

[21] Appl. No.: 765,689

[22] Filed: Feb. 4, 1977

[30] Foreign Application Priority Data

Feb. 11, 1976 [DE] Fed. Rep. of Germany ..... 2605370

[51] Int. Cl.[2] ..... D04B 15/48; B65H 51/20

[52] U.S. Cl. ..... 66/132 R; 242/47.01; 66/161

[58] Field of Search ..... 66/132 R, 161; 340/259; 200/61.13; 242/47.01, 47.12

[56] References Cited

U.S. PATENT DOCUMENTS

| | | | |
|---|---|---|---|
| 3,331,346 | 7/1967 | Firestein et al. | 200/61.13 X |
| 3,723,991 | 3/1973 | Schwartz | 340/259 |
| 3,806,677 | 4/1974 | Denlega et al. | 200/61.13 |
| 3,827,296 | 8/1974 | Hidaka | 340/259 X |
| 3,928,987 | 12/1975 | Jacobsson | 242/47.01 |
| 3,994,446 | 11/1976 | Jacobsson | 66/132 R |

FOREIGN PATENT DOCUMENTS

| | | | |
|---|---|---|---|
| 2128476 | 10/1972 | Fed. Rep. of Germany | 66/132 R |
| 2159155 | 6/1973 | Fed. Rep. of Germany | 66/132 R |
| 2160161 | 6/1973 | Fed. Rep. of Germany | 66/132 R |
| 318667 | 7/1969 | Sweden | 66/132 R |

*Primary Examiner*—Werner H. Schroeder
*Assistant Examiner*—Andrew M. Falik
*Attorney, Agent, or Firm*—Blanchard, Flynn, Thiel, Boutell & Tanis

[57] ABSTRACT

A thread supply device for a textile machine, such as a knitting machine, having a drive. The thread supply device includes a thread drum on which a thread issuing from a supply bobbin can be wound tangentially to form an intermediate thread supply and from which the thread can be removed over a removal edge of the drum. A thread-control element is positioned adjacent to the path of thread removal in the vicinity of the removal edge, and against which the thread abuts laterally due to the tension of removal during a positive thread supply mode. The thread-control element also functions as a thread tension-sensing element and is movable responsive to a decrease in the tension of the removed thread such that, when this tension falls below a predetermined value, this element activates a switching structure which stops the machine drive.

5 Claims, 4 Drawing Figures

THREAD SUPPLY DEVICE FOR TEXTILE MACHINE HAVING COMMON THREAD CONTROL AND TENSION SENSING ELEMENT

This invention relates to a thread supply device for textile machines, in particular knitting machines, comprising a thread drum upon which a thread issuing from a supply bobbin can be wound tangentially to form an intermediate supply and from which the thread can be removed off the top (in a vertical direction) over a removal edge of the drum, further comprising a thread control element positioned adjacent to the path of thread removal in the vicinity of said removal edge, against which the thread abuts laterally due to the tension of removal during the positive thread supply mode, further comprising a sensing element which is positioned adjacent to the unwinding thread, which is responsive to the thread tension and which is adapted to be connected to an electric circuit arrangement which stops the machine drive when the thread tension falls below a predetermined value.

BACKGROUND OF THE INVENTION

A thread supply device of this type is already known from U.S. Pat. No. 3,908,921. A withdrawal eye arrangement is provided there which consists of a pair of stationary withdrawal or removal eyes which are arranged in mutually spaced relation on the drum axis and between which there is provided a cut-off eye adapted to be pivoted transversely to the course of the thread. If the removal tension declines, for example because excess thread has been supplied to the textile machine, because there is dirt in the thread guide at the textile machine or because intertwined or twisted thread issuing from the thread drum has to be untangled, the cut-off eye can pivot laterally and forms a lateral thread loop between the two stationary withdrawal eyes. The circuit arrangement connected to the machine cut-off is activated at a specific angle of pivot and stops the machine. In the case of this known thread supply device the force of the thread acting on the cut-off eye must be made relatively large so that the cut-off eye is capable of pulling the thread being removed between the two stationary withdrawal eyes in a lateral fashion in the form of a loop when the removal tension drops off. This relatively large spring force, however, also acts on the thread during normal positive operation of the thread supply device so that the minimum tension in the thread to be supplied to the textile machine cannot be kept as low as would be desirable. The term "normal positive thread supply" is understood in this context to be a supply of the thread to the textile machine wherein the amount of thread supplied is constant as a function of time and is equal to the amount of thread which is wound upon the thread drum during each unit of time.

A thread supply device is described in U.S. Pat. No. 3,928,987 in which the cut-off eye is the first eye traversed by the thread in its path after leaving the withdrawal edge. It pivots due to the spring action in the same direction in which the thread passes when the removal tension drops off. A low spring force is therefore sufficient to indicate an excessive reduction in the removal tension at the cut-off. This low spring force on the cut-off eye does not cause as great an increase in the removal tension as does the withdrawal eye arrangement according to above mentioned U.S. Pat. No. 3,098,312 but nevertheless still produces removal tensions which are too high for many applications.

The object of the present invention is therefore to develop a thread supply device of the type described at the outset in such a manner that it supplies the thread with an extraordinarily low tension.

This object is accomplished in accordance with the invention in that the thread control element itself is designed as a sensing element.

In the case of the afore-cited thread supply device, a separate withdrawal eye arrangement for detecting an excessive drop in thread removal tension is superfluous. The thread can be conducted directly from the thread control element to a stationary withdrawal eye and then to the textile machine.

It is advantageous to dispose the stationary withdrawal eye substantially straight along an axial extension of the thread control element. An extremely low removal tension in the thread being removed is achieved during normal positive thread supply due to the few points of friction.

In a preferred embodiment of the thread supply device of very simple construction, it is provided that the thread control element is easily movable transversely to the course of the thread and is subject to a spring load such that the thread control element is brought into a position in which it actuates the switching assembly if the thread removal tension drops below the predetermined value.

Moreover, it is advantageous to provide a device for mechanically and/or electrically determining the mean of the cut-off signal for the machine drive, preferably being settable. This prevents brief reductions in tension in the unwinding thread which occur during normal operation and which are not to be reported as malfunctions in the thread supply which shut off the textile machine. For instance, the knots which may occur here and there in coarse effect yarns can cause such temporary drops in tension when they pass the thread guide mounted on the textile machine. Even if operations are carried out with normal yarns, these brief reductions may occur, for example due to vibrations in the textile machine which act on the passage of the thread between the thread supply device and the thread consumer in the machine.

BRIEF DESCRIPTION OF THE DRAWINGS

The invention will now be described in more detail in the following with reference to an embodiment illustrated in the drawing, in which.

DETAILED DESCRIPTION

Figure 1:
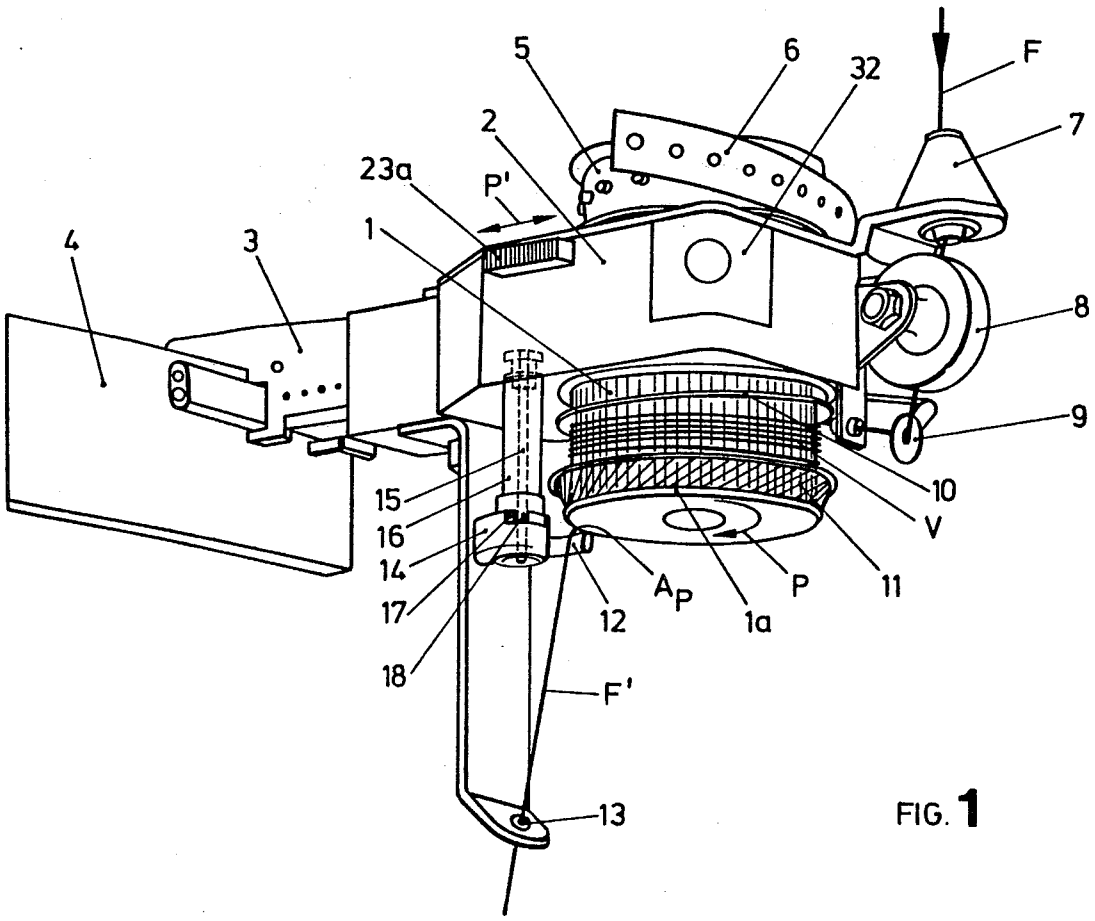
FIG. 1 is a perspective elevation of an inventive thread supply device during normal, positive thread supply.

The thread supply device has a thread drum 1 which is mounted rotatably in a housing 2. The housing 2 is clamped to a support ring 4 by a support arm 3. The support ring is in turn disposed on a textile machine, e.g. a knitting or spooling machine. In the case of a knitting machine, a thread supply device is provided for each system. The thread drum 1 drive is effected by a pin wheel 5 and a perforated tape 6 co-operating with said pin wheel and being driven in synchronism with the knitting machine. The thread F issues from a supply bobbin (not shown), passes through a preliminary brake 7, a disc brake 8 and a thread monitor 9, and is then wound tangentially onto the thread drum 1 which rotates in the direction indicated by arrow P. The thread drum 1 is associated with an inclined advance disc 10 which is described in more detail in U.S. Pat. No. 3,827,645, for example, and which advances the forming thread windings in the axial direction of the thread drum so that an intermediate thread supply V is formed on the drum. The thread is removed from this intermediate supply V over the end, beneath a braking ring 11 and over a lower removal edge 1*a* of the thread drum 1. The unwinding thread F′ passes over a thread control element in the form of a hook 12 — it will be described in more detail below — and thereafter passes through a stationary thread eye 13.

From the thread eye 13, the thread arrives at the processing station of the textile machine, e.g. the thread guide of a knitting system of a knitting machine.

The hook 12 is secured in the hub 14 which is fixed on a shaft 15. This shaft 15 is rotatably mounted in a support post 16 whose upper end is mounted in the housing 2. The hub 14 has a small recess 17 which co-operates with a stop 18 on the support post 16 so that the hub 14 together with the hook 12 can rotate only through a specified angle. A circular disc 19 is eccentrically secured to the upper end of the shaft 15 which is located in the housing 2. A spring 20 is positioned between a first small pin 21 on the disc 19 and a second small pin 22 on a regulator 23 which includes a regulator part 23*a* projecting out of the housing 2 through an elongated slot 24. The part 23*a* has a camlike projection 23*b* thereon which is engageable within one of a series of grooves 23*c* formed on the exterior of the housing to permit the regulator 23 to be selectively positioned with respect to the housing.

Figure 2:
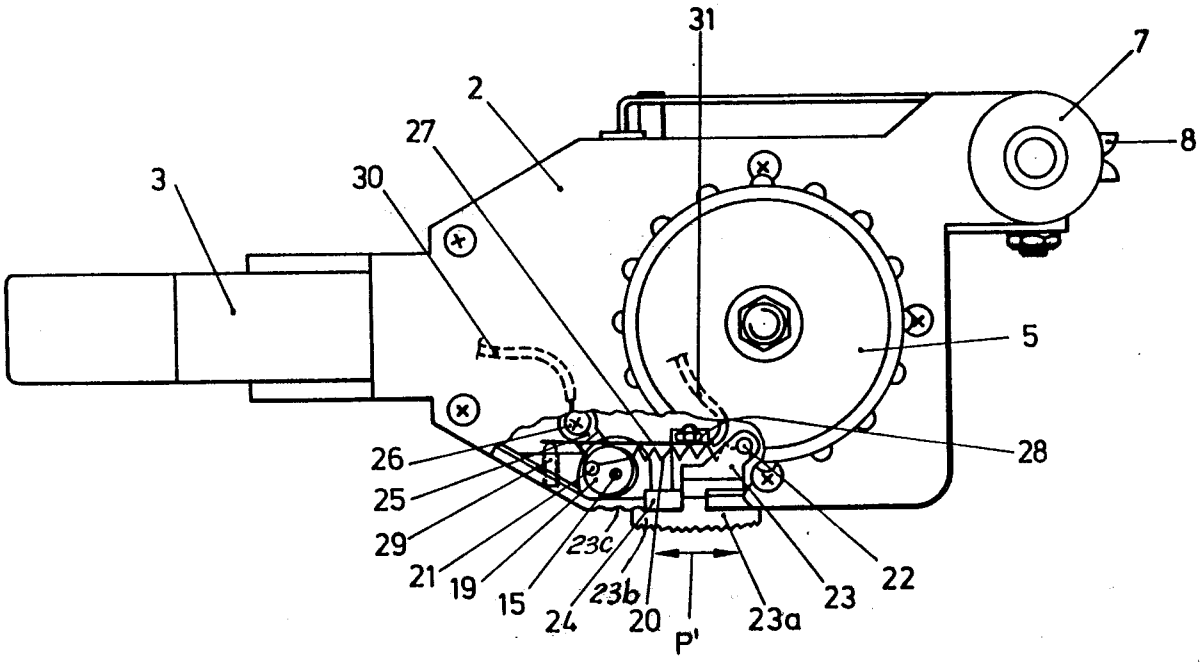
FIG. 2 is a partially sectional top elevation of the thread supply device according to FIG. 1.

The shaft 15 and thus the hook 12 are spring-loaded by the spring 20 so that is tends to rotate in a clockwise direction in top elevation (FIG. 2). The regulator 23 may be manually moved along the direction of the slot 24 as indicated by the double arrow P′ shown in the drawing, thereby displacing the pin 22 and hence varying the spring load acting on the hook 12. This may be desirable, for example, when switching from a supply of coarse yarns to fine ones and vice-versa.

The underside of the disc 19 is always in contact with the one end of a first contact plate 25 whose other end is screwed to a cable holder 26. The one end of a second contact plate 27 is screwed to another cable holder 28, and plate 27 extends past the disc 19 and abuts with its free end on an adjusting screw 29.

OPERATION

The mode of operation of the afore-described device is as follows: The thread segment F′ is removed over the drum end in a downward direction under tension and/or is unwound from the thread drum 1. The removal speed and the speed of the thread drum 1 are matched such that the unwinding thread F′ has a slight tendency to migrate contrary to the direction of thread drum rotation P around the removal edge 1*a* (to be imagined in an upright position). This migratory movement of thread F′, however, is obstructed by the hook 12 so that the location at which the thread F′ leaves the removal edge 1*a* is normally fixed spacially. This normal removal site is characterized as Ap in FIG. 1. It is immediately above the hook 12. Due to the fixed position of the removal site Ap contrary to the direction of drum rotation, only as much thread can be removed from the drum 1 as is released during its rotation at the removal site Ap above the hook 12. This mode of operation is termed positive thread supply.

The removal tension which occurs in the unwinding thread F′ stretches the thread between the removal site Ap and the withdrawal eye 13. This stretched thread maintains the hook 12 in the position shown in FIG. 1 against the force of the spring 20 which acts against it. It is evident from FIG. 2 that the disc 19 is not in contact with the contact plate 27 in this position. This means that the electrical circuit, which starts at the central cut-off relay of the textile machine and includes cables 30 and 31, cable holder 26, contact plate 25, disc 19, contact plate 27 and cable holder 28 (the latter parts being accommodated in the thread supply device), is open. The textile machine is in operation in this switching position.

Figure 3:
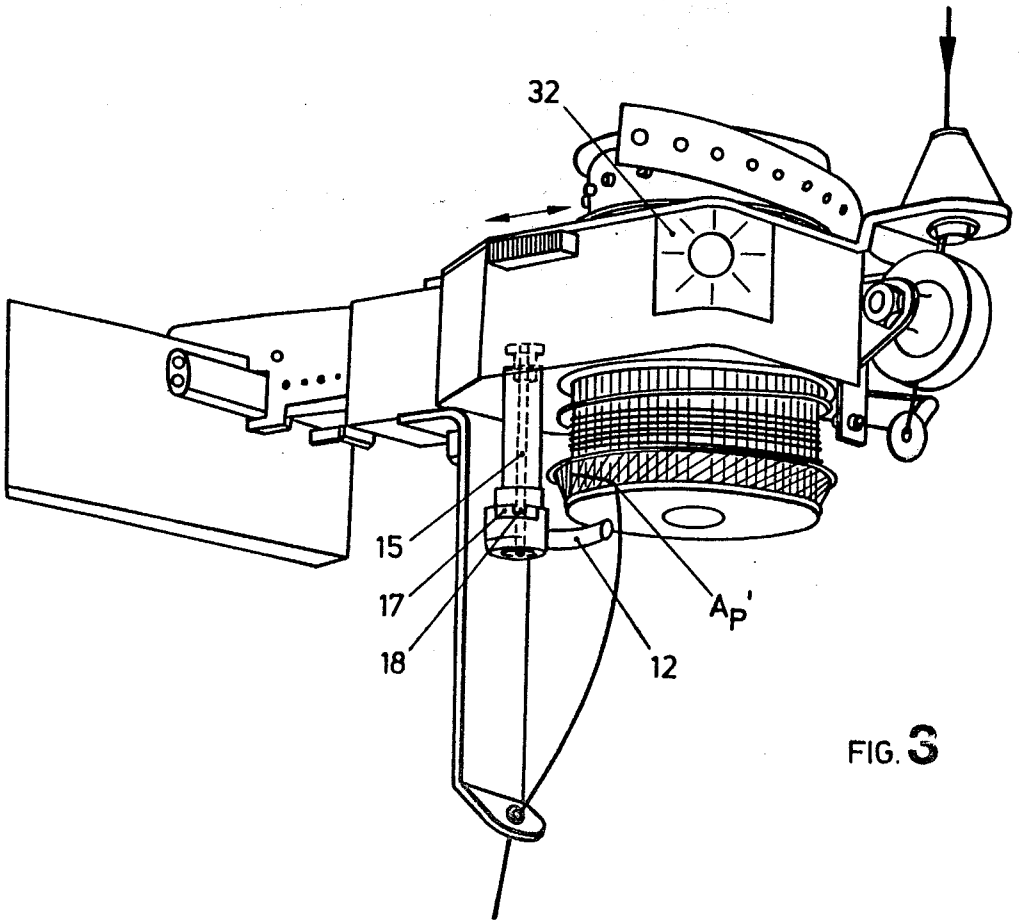
FIG. 3 is the thread supply device according to FIG. 1 in its indicative mode with a large excessive drop in the removal tension of the unwinding thread.
Figure 4:
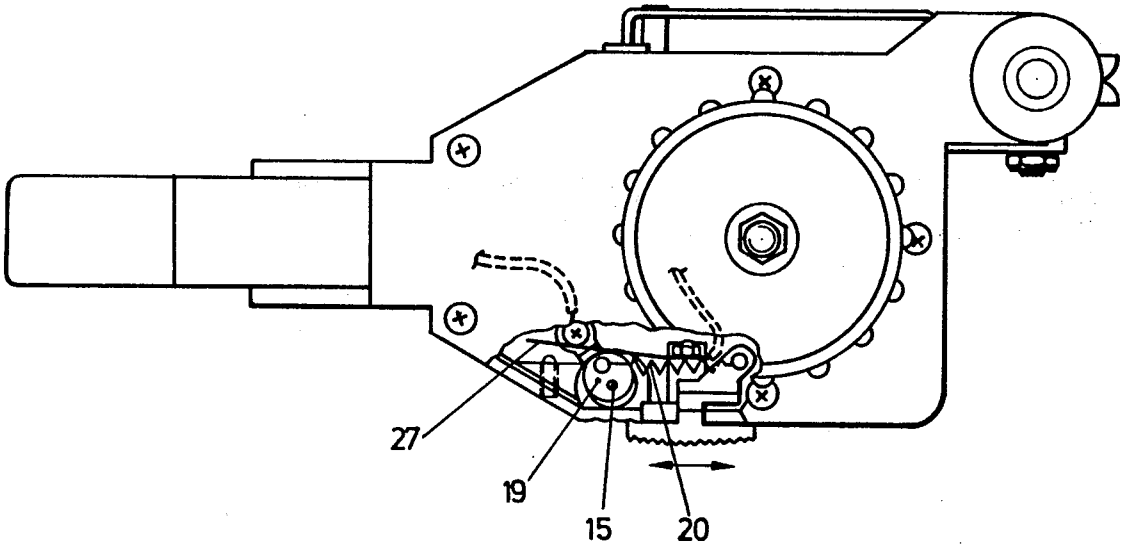
FIG. 4 is a partially sectional top elevation of the thread supply device in the indicative mode according to FIG. 3.

If the thread removal tension drops off, e.g. because the textile machine does not consume as much thread as the thread supply device is supplying, or because the thread has jammed somewhere along the thread path between the thread supply device and the textile machine, e.g. due to dirt in the thread guide, or because a previously formed loop opens along the path between the thread supply device and the textile machine, the tendency of the unwinding thread F′ caused by the removal tension to migrate about the removal edge 1*a* contrary to the direction of rotation P stops and the thread drum 1 pulls the unwinding thread F′ along somewhat in the direction of rotation P. This reduces the force which causes the thread to abut laterally against the hook 12, or it is even reduced to zero when the thread F′ becomes so slack that it leaves the hook 12 and laterally emerges from the mouth of the hook as shown in FIG. 3, thereby causing the removal site to move to position Ap′. The result is that the hook 12 rotates in a clockwise direction in top elevation as shown in FIG. 3 due to the spring action caused by the spring 20. In so doing, the disc 19 also rotates in a clockwise direction in top elevation as is obvious in FIG. 4 so that it comes into contact with the contact plate 27, thereby closing the afore-mentioned electrical circuit which is connected to the central cut-off relay and in turn stopping the textile machine. At the same time, a warning light 32 connected to the afore-mentioned circuit is energized do that the operator can directly detect the system in which the malfunction has occurred. A control circuit of this type is illustrated in my earlier U.S. Pat. No. 3,918,036, particularly FIG. 2*a* wherein the switch 14 functions in the circuit in the same manner as the switch defined by contact plates 25 and 27 of this invention.

It is desirable, if not even necessary, to prevent the machine drive from being shut off when the thread tension falls below the predetermined value only briefly. The time interval should advantageously be adjustable. Such suppression of the cut-off process by "formation of a mean value" can be achieved either mechanically and/or electrically. A mechanical solution is illustrated in the drawing. The distance between the disc 19 and the contact plate 27 can be adjusted by means of the adjusting screw 29 so that the hook 12 must rotate through a set angle before the disc 19 comes into contact with the contact plate 27 in order to close the circuit for the warning signal. This prevents brief drops in tension from being reported because the spring-loaded hook 12 cannot rotate through the angle required to activate a switching operation during these brief drops due to its inertia. The magnitude of the angular path determines the duration of the fluctuations which may occur without activating a switching operation. In principle, this is the formation of a mean value of the different thread tensions during a specified time interval. This mean value formation can be triggered electrically simply by connecting between the above-described circuit in the thread supply device and the cut-off relay a conventional electrical integration circuit in the simplest form of a conventional RC circuit for suppressing brief drops in tension. Such an RC or integration circuit is well-known and persons of ordinary skill in this technology would fully understand the addition of same to the basic electrical circuit as provided in the usual apparatus of this type.

The invention is not limited to the embodiment which is described above and shown in the drawing. For example, the hook may also be replaced by a straight bar. It is not necessary either to employ a thread control element which does not encompass the unwinding thread. In place of a hook or a bar, a short arm secured in the hub 14 ahd having a thread eye provided on its free end through which the unwinding thread F' passes, can also be used for instance.

Moreover, as far as the electrical switching arrangement activated by the thread control element and the means for forming the mean value of the warning signal to the cut-off means are concerned, many possible embodiments exist. Finally, it should be mentioned that the invention is also applicable in principle to thread supply devices with stationary thread drums. In this case a winding element which encircles the thread drum is provided to which the thread control element is attached. During positive thread supply the thread control element limits the unwinding speed to the winding speed. The unwound thread also shows the same tendency here to rest against the thread control element. The essential difference is merely that the removal site on the edge of the thread drum continuously rotates in synchronism with the winding element. It is expedient to use a slip ring as is shown by U.S. Pat. No. 3,994,446. to transmit the cut-off signal from the rotating winding element to the stationary parts.

What is claimed is:

1. In a thread supply device for a textile machine, in particular a knitting machine, said thread supply device including drum means upon which a thread can be tangentially wound to form an intermediate thread storage and from which the thread can be unwound axially over a withdrawal rim associated with the drum means, a stationary thread guide member disposed in axially spaced relationship from the withdrawal rim for guiding the thread withdrawn from said drum means after it passes over the withdrawal rim, thread engagement means positioned for engagement with the withdrawn thread as it extends from said withdrawal rim to said thread guide member for (1) limiting the maximum rate at which the thread can be withdrawn from the drum means and (2) sensing the tension in the withdrawn thread, and switching means interconnected to said thread engaging means and actuated in response to the sensing of a decrease in the withdrawn thread tension below a predetermined value, comprising the improvement wherein said thread engaging means includes a single thread engaging element positioned adjacent the withdrawal rim and normally disposed in engagement with the withdrawn thread after it passes over the withdrawal rim, frame means supporting both said drum means and said thread engaging element for permitting one of said drum means and thread engaging element to be rotated relative to the other substantially about the longitudinal axis of said drum means, said thread engaging element also being supported for movement between first and second positions independently of said above-mentioned relative rotation, said thread engaging element being normally maintained in said second position when the tension in the withdrawn thread equals or is greater than said predetermined value for limiting the withdrawal rate of thread from said drum means, and means for normally urging the thread engaging element away from said second position toward said first position, whereby a decrease in the thread withdrawal tension permits the thread engaging element to move toward the first position and into said first position when the thread withdrawal tension falls below said predetermined value.

2. A thread supply device according to claim 1, wherein the thread removed from the drum means after passing over the withdrawal rim then passes directly over the thread engagement means and then directly over the stationary thread guide member without contacting any other part of the thread supply device.

3. A thread supply device according to claim 1, wherein said switching means is activated when said thread engaging element is moved into said first position.

4. A thread supply device according to claim 1, wherein said thread engaging element comprises a hooklike member supported for pivotal movement between said first and second positions about an axis which extends substantially parallel with the longitudinal axis of said drum means, said hooklike member being swingable through only a small angular extent when being displaced between said first and second positions, stop means cooperating with said hooklike member for defining said first and second positions, and said urging means comprising a spring interconnected to said hooklike member for urging same toward said first position, and the withdrawn thread as it extends from the withdrawal rim to the stationary thread guide member being disposed in engagement solely with said hooklike member.

5. In a thread supply device for a textile machine, in particular a knitting machine, said thread supply device including drum means upon which a thread can be tangentially wound to form an intermediate thread storage and from which the thread can be unwound axially over a withdrawal rim associated with the drum means, a stationary thread guide member disposed in axially spaced relationship from the withdrawal rim for guiding the thread withdrawn from said drum means after it passes over the withdrawal rim, thread engagement means positioned for engagement with the withdrawn thread as it extends from said withdrawal rim to said thread guide member for (1) limiting the maximum rate at which the thread can be withdrawn from the drum means and (2) sensing the tension in the withdrawn thread, and switching means interconnected to said thread engaging means and actuated in response to the sensing of a decrease in the withdrawn thread tension below a predetermined value for stopping the drive of the knitting machine, comprising the improvement wherein said thread engaging means includes a single thread engaging element movably positioned adjacent the withdrawal rim and normally disposed in engagement with the withdrawn thread after it passes over the withdrawal rim, the thread removed from the drum means after passing over the withdrawal rim then passing directly over the thread engaging element and then directly over the stationary thread guide member without contacting any other part of the thread supply device, whereby a decrease in the withdrawn thread tension permits movement of the thread control element to effect actuation of said switching means to thereby stop the machine drive.

* * * * *